United States Patent [19]

Tuchscherer

[11] 4,203,015

[45] May 13, 1980

[54] ROLLER BANK SENSOR CONTACT SYSTEM

[75] Inventor: Lawrence D. Tuchscherer, Goleta, Calif.

[73] Assignee: General Motors Corporation, Detroit, Mich.

[21] Appl. No.: 948,963

[22] Filed: Oct. 5, 1978

[51] Int. Cl.[2] ..... H01H 35/14

[52] U.S. Cl. ..... 200/61.45 R; 200/61.53; 200/DIG. 45

[58] Field of Search ..... 200/61.45 R, 61.53, 200/DIG. 45, 239, 240, 241, 242, 252, 254, 67 DB, 153 R

[56] References Cited

U.S. PATENT DOCUMENTS

| | | | |
|---|---|---|---|
| 3,467,139 | 9/1969 | Richards | 200/67 DB X |
| 3,571,540 | 3/1971 | Richards | 200/67 DB |
| 4,157,462 | 6/1979 | Blanchard | 200/61.45 R |

*Primary Examiner*—James R. Scott

*Attorney, Agent, or Firm*—Herbert Furman

[57] ABSTRACT

A pair of elongated movable contact members commonly secured to the bands between the adjacent portions thereof. The contact members project toward the proximal end wall of the sensor recess and are provided with flared proximal free end portions. The angularly related walls of a generally V shaped fixed contact project from the distal end wall of the sensor recess and are engaged by the movable contact members at actuated position. The end portions of the movable contact members laterally expand and the walls of the fixed contact laterally contract to absorb the energy of the moving mass of the sensor and eliminate contact bounce while maintaining electrical contact between the contact members to close an electrical control circuit. The distal end portions of the contact members may engage the distal end wall of the housing or an adjustable set screw to locate the roller bands and movable contact members in preload or unactuated position.

5 Claims, 6 Drawing Figures

ROLLER BANK SENSOR CONTACT SYSTEM

GENERAL BACKGROUND

This invention relates generally to roller band sensors and more particularly to a contact system for roller band sensors.

The contact system of this invention is intended primarily for use with the roller band sensor disclosed and claimed in copending application Ser. No. 845,607, Sensor, Houston F. Blanchard, filed Oct. 26, 1977 now U.S. Pat. No. 4,157,462, and assigned to the assignee of this invention.

Generally such a roller band sensor includes a pair of bands of flexible spring material of generally figure 8 configuration. The bands both roll and elongate relative to each other during movement between a preload position and an actuated position within the cavity of a housing. The bands are constrained from their free generally circular shape to an elongated shape by the spaced walls or bearing portions of the housing cavity. The adjacent portions of the bands are commonly secured to each other and the remote portions of the bands are secured to a respective bearing portion of the cavity. The force of the bands tending to return the bands to their free generally circular shape biases the bands toward the preload position adjacent the distal end wall of the cavity. A velocity or acceleration change of predetermined extent moves the bands from the preload position to the actuated position adjacent the proximal end wall of the housing cavity.

BRIEF SUMMARY OF THE INVENTION

In accordance with this invention, a pair of elongated movable contact members fit between the adjacent portions of the bands and have their intermediate portions commonly secured thereto. The distal free end portions of the contact members engage either a rib on the distal wall of the housing cavity or an adjustable set screw on such wall in order to locate the bands in preload position. The proximal free end portions of the contact members are of reduced width relative to the bands and terminate in oppositely extending outwardly flared end portions. A generally V shaped fixed contact member is mounted on the housing and projects into the housing cavity from the proximal end wall thereof. Upon movement of the bands to actuated position, the flared end portions of the movable contact members engage the triangularly related walls of the fixed contact member adjacent their apical juncture to laterally separate the movable contact members and laterally contract the fixed contact member to thereby absorb the energy of the moving mass of the sensor and eliminate contact bounce while maintaining closure for the required time necessary to actuate an electrical control system controlled by the sensor.

One feature of this invention is that it provides a roller band sensor contact system having a pair of flexibly related movable contact members which wipingly engage a pair of flexibly related fixed contact members upon actuation of the sensor to absorb the energy of the moving mass of the sensor and eliminate contact bounce. Another feature is that one pair of contact members laterally separate and the other pair of contact members laterally contract upon closure engagement of the contact members to absorb the energy of the moving mass of the sensor. A further feature is that the movable contact members are laterally separable and are carried by the roller bands while the fixed contact members are laterally contractable and are carried by the sensor housing. Yet another feature is that the free end portions of the movable contact members wipingly engage angularly related walls of the fixed contact member adjacent their apical juncture upon closure engagement of the contact members. Yet a further feature is that the movable contact members are intermediately secured to the roller bands and have their distal portions engaging means on the sensor housing to locate the roller bands in preload position. Still another feature is that the angularly related side walls of the fixed contact member may be interconnected by energy absorbing foam material.

BRIEF DESCRIPTION OF THE DRAWINGS

These and other features of the contact system of this invention will be readily apparent from the following specification and drawings wherein.

BRIEF DESCRIPTION OF THE PREFERRED EMBODIMENT

Figure 1:
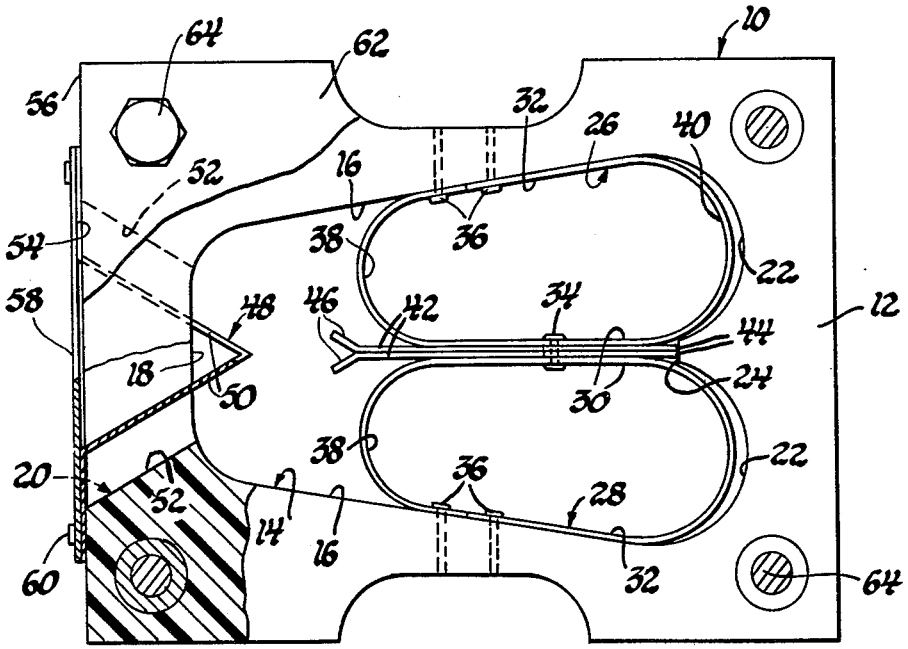
FIG. 1 is a partially broken away plan view of a roller band sensor having a contact system according to this invention, with the roller bands being shown in preload position.
Figure 2:
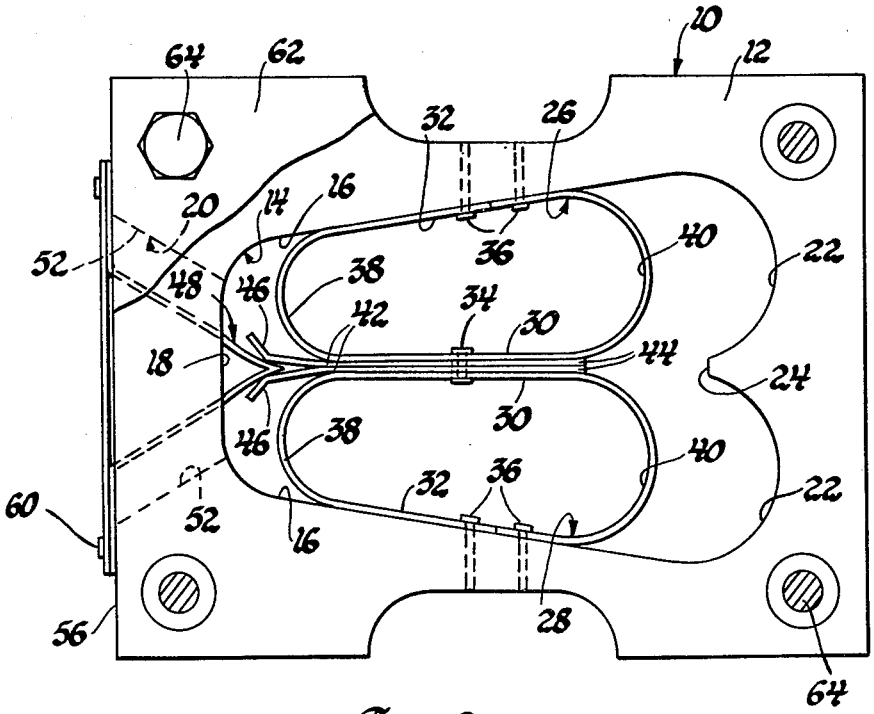
FIG. 2 is a view similar to FIG. 1 showing the roller bands in actuated position.
Figure 3:
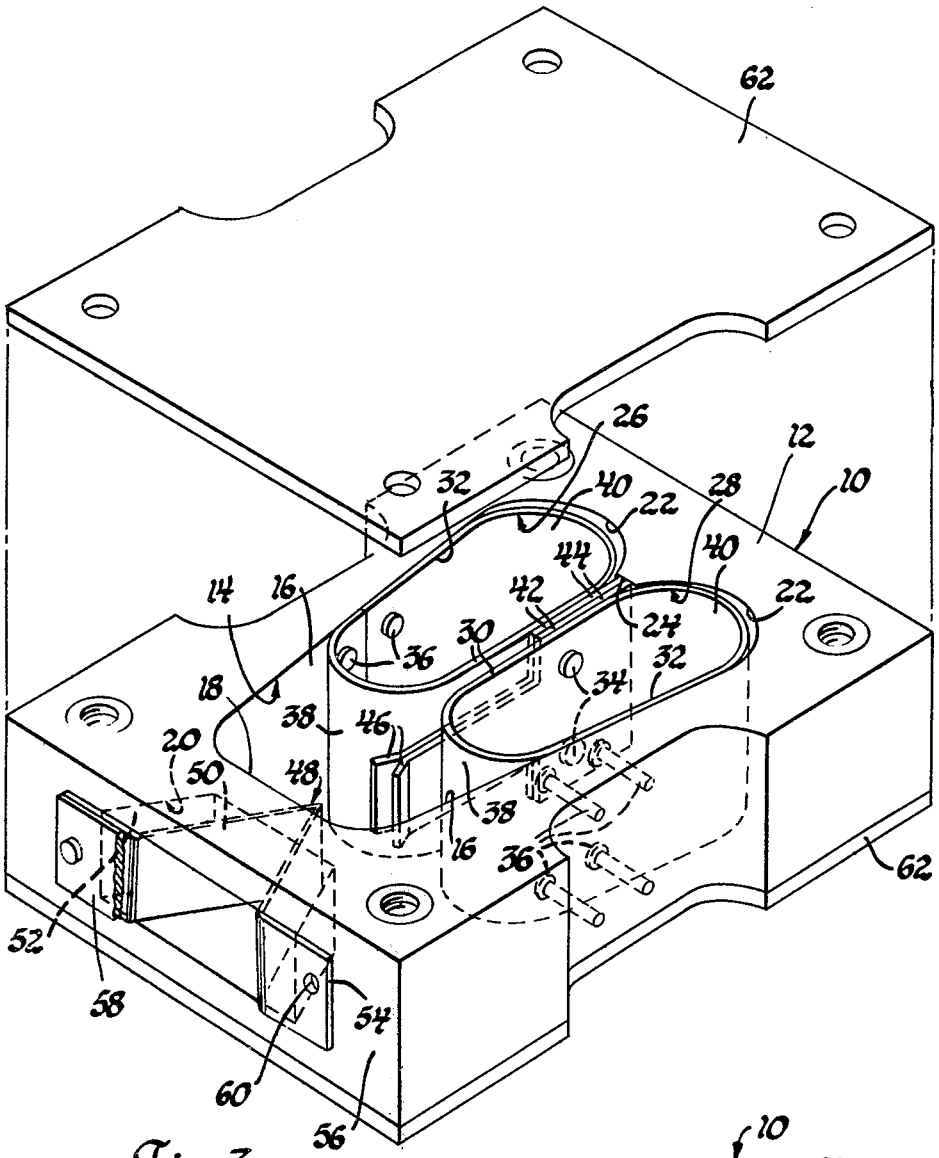
FIG. 3 is a partially exploded perspective view.

Referring now to FIGS. 1 through 3 of the drawings, a roller band sensor 10 includes a housing 12 of electrically non-conductive material, such as fiber reinforced plastic.

The housing 12 includes a cavity 14 which includes a pair of linear bearing portions or side walls 16 which merge at their proximal ends into a proximal end wall 18. The proximal end of housing 12 encloses a triangularly shaped recess 20 opening to cavity 14 through wall 18. The distal ends of the walls 16 tangentially merge into arcuate end walls 22 joined by a flat rib 24 and cooperatively defining the distal end wall of cavity 14. The walls 16 may be slightly tapered as shown to define a predetermined included angle, the bisector of which bisects wall 18 and rib 24. In the embodiment shown, the included angle of walls 16 is 16.6 degrees.

A pair of roller bands 26 and 28 of flat spring steel material are located within the cavity 14. The bands 26 and 28 are generally of figure 8 configuration and have adjacent side portions 30 located coplanar with the bisector of the included angle, and remote side portions 32 engaged in surface to surface relationship with a respective wall 16.

The adjacent side portions 30 of the bands 26, 28 are commonly secured to each other by rivets 34 aligned transversely of the bands. The remote side portions 32 of each band is secured to a respective side wall 16 by pairs of rivets 36 also aligned transversely of a respective band. The bands should not move relative to each other at the common anchor 34 and each band likewise should not move relative to a respective wall 16 at rivets 36.

Although each band 26, 28 is shown with the free edges of its remote portion abutting between the aligned pairs of rivets 36, the bands may be of other types as shown in the aforenoted Blanchard application.

Each band 26, 28 in its free position has a generally circular shape. When the bands are disposed between the walls 16, the bands are forced or constrained to elongate and assume the shape shown. The integral force of the bands tending to return the bands to their free generally circular shape forces the bands toward the distal end walls 22 to provide a preload force resisting movement of the bands toward the proximal end wall 18.

When the automobile or other article on which the sensor is mounted is subjected to a velocity change of predetermined extent or an acceleration change of predetermined amplitude and time, the bands 26, 28 move from the preload position of FIGS. 1 and 3 to the actuated position of FIG. 2. Each band rolls oppositely of the other along a respective wall 16 as the adjacent side portions 39, forwardly or proximally of rivets 34, tangentially merge into continuations of respective arcuate proximal portions 38 which tangentially move into engagement with respective walls 16 as continuations of remote side portions 30, forwardly or proximally of rivets 36.

Concurrently, the distal arcuate band portions 40 tangentially merge into continuations of adjacent portions 30, rearwardly or distally of rivets 34 while remote side portions 32 tangentially separate from respective walls 16, rearwardly or distally of rivets 36, and tangentially merge into continuations of distal arcuate portions 40.

The foregoing brief description of the roller band sensor 10 is believed adequate for an understanding of this invention. If further details are desired, reference may be had to the aforenoted Blanchard application.

In accordance with this invention, a pair of like elongated movable contact members 42 fit between the bands 26 and 28 and are intermediately secured to each other and to the bands by the rivets 34 whereby the contact members move forwardly or proximally of the cavity 14 when the bands 26 and 28 so move as previously described. The rearward or distal end portions 44 of the contact members 42 engage the rib 24 as shown in FIG. 1 in order to maintain the bands 26 and 28 in their preload position spaced from the distal end walls 22 of the cavity 14. If desired, the distal end portions of the contact members 42 may be shortened so as not to engage rib 24. Other means such as having the arcuate portions 40 of the bands engaging the distal end walls 22, may be used to locate the bands 26, 28 in their preload position, as set forth in the aforenoted Blanchard application.

With reference to FIG. 3, it will be noted that the forward or proximal end portion of each contact member 42 is scalloped or reduced in width forwardly of the rivets 34, and each terminates in a slightly angled or flared portion 46 for a purpose to be hereinafter described.

A stationary contact member 48 of generally V shape fits within the recess 20 of the housing 12. The triangularly related side walls 50 of contact member 48 are spaced from the respective juxtaposed walls 52 of recess 20 and project rearwardly or distally of wall 18 into cavity 14. Walls 50 are integrally joined at their apical juncture.

Each wall 50 terminates in a lateral flange 54 which seats against the proximal end wall 56 of housing 12. A plate or reinforcement 58 seats against flanges 54 and covers the opening of recess 20 through walls 56 and 18. Rivets 60 secure plate 58 and flanges 54 to the wall 56. The plate 58 insures that the walls 50 of contact member 48 will flex or move toward and away from each other relative to their apical juncture as will be described.

When the roller bands 26 and 28 move toward their actuated position shown in FIG. 2, the portions 46 of the contact members 42 wipingly engage the walls 50 of the contact member 48 adjacent their apical juncture. The proximal end portions of the contact members 42 partially separate from each other as shown in FIG. 2 forwardly of their tangentially juncture with bands 26 and 28, while the walls 50 of the contact member 48 flex or contract relative to each other. By laterally separating the proximal portions of the contact members 42 and laterally contracting the walls 50 of contact members 48, the energy of the moving mass of the sensor, comprised of the bands 26 and 28, the contact members 42, and rivets 24, is absorbed and dissipated and contact bounce is eliminated.

By eliminating contact bounce and having the contact members 42 and 48 wipingly engage each other, the minimum closure time required to actuate the electrical control system controlled by the sensor 10 is obtained. Normally this minimum closure time varies from 1 to 3 ms, and unless the contact members 42 and 48 maintain engagement for this time duration, the electrical control system will not be actuated.

The plate 58 insures that the contact member 48 will not bodily move as a unit longitudinally of sensor 10 when engaged by contact members 42. Thus, the flexing or contracting of walls 50 about their apical juncture is obtained.

The upper and lower sides of cavity 14 are closed by cover plates 62, the shape of which matches the shape of like sides of housing 10. The cover plates are secured to the housing over the cavity 14 by bolts 64. By having the forward or proximal portions of the contact members 42 of lesser width or depth than that of the bands 26 and 28, it is impossible for such portions of the contact members to in any way engage the cover plates and provide possible interference to movement of the roller bands 26 and 28 toward actuated position.

The sensor 10 may be connected between a source of power and an electrical control system in any appropriate manner such as by connecting the rivets 36 of both of the roller bands to B+ or ground and alternately connecting the rivets 60 to ground or to B+.

Figure 4:
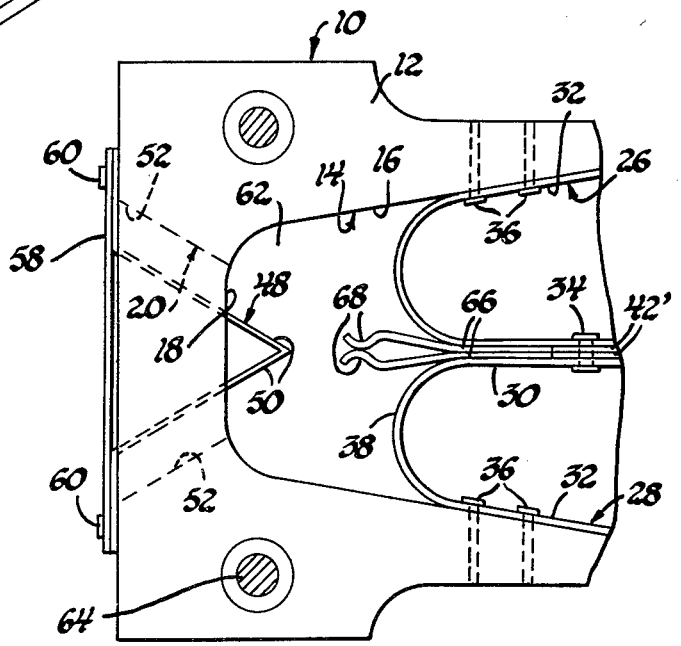
FIG. 4 is a parial view of a second embodiment.

FIG. 4 shows a modification of this invention and like numbers are used for like parts. The forward portions 66 of the contact members 42' of FIG. 4 are of reduced thickness or scalloped in the same manner as the forward portions of the contact members 42 of the embodiment shown in FIGS. 1 to 3. However, the forward terminal edge portions 68 of the contact members 42' are of semi-circular ribbed configuration with the ribbed portions 68 opening oppositely of each other and contacting each other in the normal or preload position of the roller bands. When the roller bands 26 and 28 move to actuated positions, not shown, the ribbed portions 68 engage the side walls 50 of contact member 48 adjacent their apical juncture, as previously described, and move apart or laterally separate relative to each other as walls 50 move inwardly or laterally contract relative to each other to dissipate the energy of the moving mass of the sensor and eliminate contact bounce.

Figure 5:
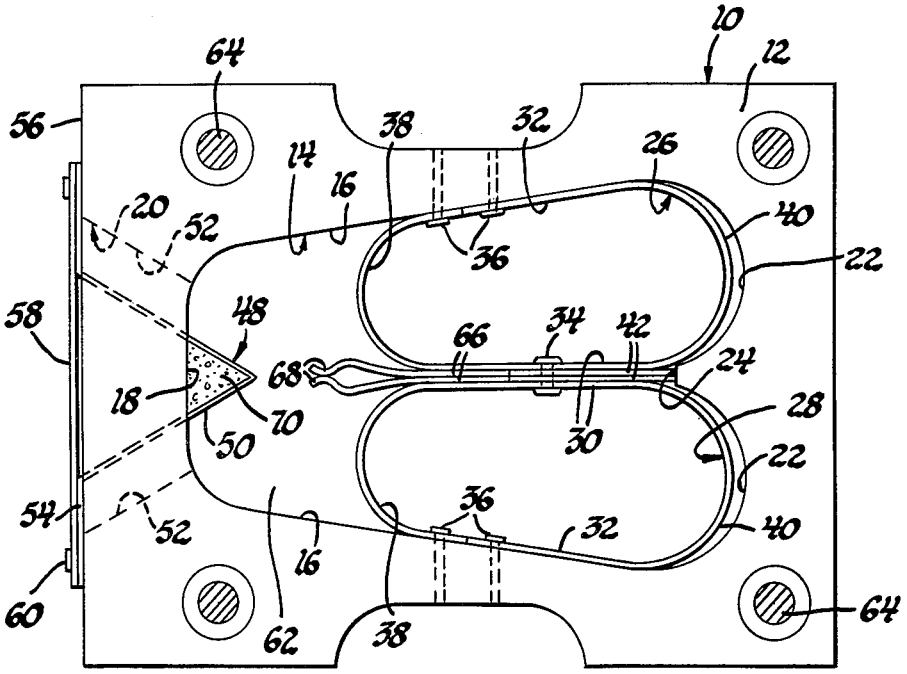
FIG. 5 is a plan view of a third embodiment.

FIG. 5 shows another modification wherein like numerals are again used for like parts. In this modification, the walls 50 of the contact member 48 are connected by soft cellular boom material 70 to inhibit some types of intermittent contact. The foam material 70 may or may not be necessary and may be included in the embodiment shown in FIGS. 1 to 3.

Figure 6:
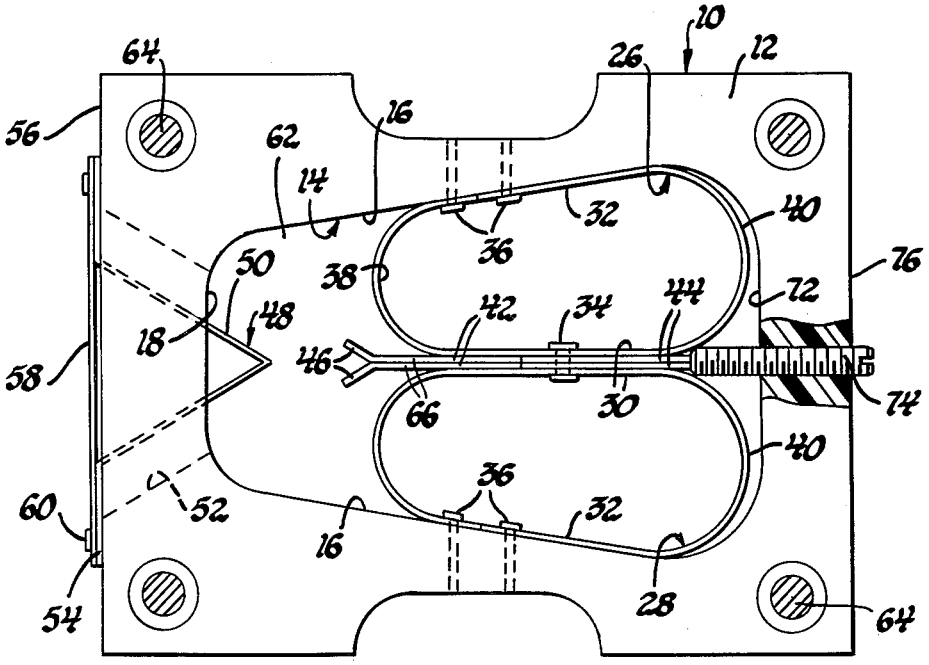
FIG. 6 is a plan view of a fourth embodiment.

FIG. 6 shows another modification. In FIG. 6, the arcuate distal end walls 22 and the rib 24 are dispensed with and a generally planar wall 72 provides the distal end wall of the cavity 14. A set screw 74 is threaded into a tapped opening through the distal end wall 76 of housing 12 and adjustably engages the rearward or distal end portions 44 of contact members 42 in order to adjustably locate the bands 26 and 28 in preload position. This embodiment may also be used with the embodiments shown in FIGS. 4 and 5.

Thus, this invention provides an improved contact system for roller band sensors.

The embodiments of the invention in which an exclusive property or privilege is claimed are defined as follows:

1. In a sensor having a housing provided with a pair of spaced linear bearing portions, a pair of flexible bands of spring material disposed between the bearing portions and being forced thereby into generally elongate shape, the adjacent portions of the bands being secured to each other and the remote portions of the bands engaging and being secured to a respective bearing portion, a velocity change of predetermined extent causing the bands to concurrently roll relative to each other along the bearing portions and linearly translate the adjacent secured portions of the bands relative to the bearing portions, the improvement comprising, a pair of first elongated resilient contact members intermediately secured to the bands and having free end portions extending oppositely therefrom and a pair of flexibly related angular second contact members mounted on the housing in spaced relationship to the first contact members and interengageable therewith, the first contact members laterally separating and the second contact members laterally and flexibly contracting about their apical juncture upon interengagement to thereby substantially eliminate contact bounce.

2. In a sensor having a housing provided with a pair of spaced linear bearing portions, a pair of flexible bands of spring material disposed between the bearing portions and being forced thereby into generally elongate shape, the adjacent portions of the bands being secured to each other and the remote portions of the bands engaging and being secured to a respective bearing portion, a velocity change of predetermined extent causing the bands to concurrently roll relative to each other along the bearing portions and linearly translate the adjacent secured portions of the bands relative to the bearing portions, the improvement comprising, first contact means extending from the adjacent secured portions of the bands for translation therewith, and second contact means mounted on the housing in spaced relationship to the first contact means and interengageable therewith upon translation thereof, one contact means being laterally separable and the other contact means being laterally contractable about an apical juncture thereof upon interengagement of the contact means to substantially eliminate contact bounce.

3. In a sensor having a housing provided with a pair of spaced linear bearing portions, a pair of flexible bands of spring material disposed between the bearing portions and being forced thereby into generally elongate shape, the adjacent portions of the bands being secured to each other and the remote portions of the bands engaging and being secured to a respective bearing portion, a velocity change of predetermined extent causing the bands to concurrently roll relative to each other along the bearing portions and linearly translate the adjacent secured portions of the bands relative to the bearing portions, the improvement comprising, first contact means extending from the adjacent secured portions of the bands for translation therewith and including a pair of resiliently separable contact members, and second contact means mounted on the housing in spaced relationship to the first contact means and including a pair of contact members laterally contractable about an apical juncture, the second contact members being interengageable with the first contact members upon translation thereof to resiliently separate said first contact members while concurrently laterally contracting to thereby substantially eliminate contact bounce.

4. In a sensor having a housing provided with a pair of spaced linear bearing portions, a pair of flexible bands of spring material disposed between the bearing portions and being forced thereby into generally elongate shape, the adjacent portions of the bands being secured to each other and the remote portions of the bands engaging and being secured to a respective bearing portion, a velocity change of predetermined extend causing the bands to concurrently roll relative to each other along the bearing portions and linearly translate the adjacent secured portions of the bands relative to the bearing portions, the improvement comprising, first contact means including a pair of elongated resilient contact members secured at one end thereof to the adjacent secured portions of the bands for translation therewith and having their other free ends resiliently separable, and a generally V shaped second contact member having the apically joined legs thereof mounted on the housing and located in spaced relationship to the free ends of the first contact members, translation of the first contact members into engagement with the legs of the second contact member resiliently separating the free ends of the first contact members and concurrently contracting the legs of the second contact member to substantially eliminate contact bounce.

5. In a sensor having a housing provided with a pair of spaced linear bearing portions, a pair of flexible bands of spring material disposed between the bearing portions and being forced thereby into generally elongate shape, the adjacent portions of the bands being secured to each other and the remote portions of the bands engaging and being secured to a respective bearing portion, a velocity change of predetermined extent causing the bands to concurrently roll relative to each other along the bearing portions and linearly translate the adjacent secured portions of the bands relative to the bearing portions, the improvement comprising, first elongated contact means having free end portions extending oppositely from the adjacent secured portions of the bands, means on the housing engaging one free end portion to locate the bands in unactuated position, and second contact means mounted on the housing in spaced relationship to the other free end portion of the first contact means and having a free end portion interengageable therewith upon translation thereof to substantially eliminate contact bounce, one free end portion of one contact means including laterally separable contact members and the free end portion of the other contact means including apically joined laterally contractable contact members.

* * * * *

UNITED STATES PATENT AND TRADEMARK OFFICE

CERTIFICATE OF CORRECTION

PATENT NO. : 4,203,015

DATED : May 13, 1980

INVENTOR(S) : Lawrence D. Tuchscherer

It is certified that error appears in the above-identified patent and that said Letters Patent are hereby corrected as shown below:

Title page, "ROLLER BANK SENSOR CONTACT SYSTEM" should read -- ROLLER BAND SENSOR CONTACT SYSTEM -- .

Column 1, "ROLLER BANK SENSOR CONTACT SYSTEM" should read -- ROLLER BAND SENSOR CONTACT SYSTEM -- .

Column 2, line 28, "FIG. 4 is a parial view of a second embodiment;" should read -- FIG. 4 is a partial plan view of a second embodiment; -- .

Column 3, line 20, the numeral "39" should read the numeral -- 30 -- .

Column 4, line 12, "tangentially" should read -- tangential -- .

Column 4, line 19, the numeral "24" should read the numeral -- 34 -- .

Column 6, line 26, "extend" should read -- extent -- .

Signed and Sealed this

*Twenty-ninth* Day of *July 1980*

[SEAL]

*Attest:*

SIDNEY A. DIAMOND

*Attesting Officer*

*Commissioner of Patents and Trademarks*